US006823603B1

(12) United States Patent
Tindall

(10) Patent No.: US 6,823,603 B1
(45) Date of Patent: Nov. 30, 2004

(54) DEVICE FOR ENABLING A SINGLE USER TO EASILY AND ACCURATELY MARK RIGHT AND OBLIQUE ANGLES AND METHOD FOR EMPLOYING SAME

(76) Inventor: Justin L. Tindall, 83 Golf Pkwy., Unit H, Madison, WI (US) 53704

( * ) Notice: Subject to any disclaimer, the term of this patent is extended or adjusted under 35 U.S.C. 154(b) by 0 days.

(21) Appl. No.: 10/350,238

(22) Filed: Jan. 23, 2003

(51) Int. Cl.[7] ..... B43L 7/10

(52) U.S. Cl. ..... 33/471; 33/453; 33/463; 33/465; 33/558.04

(58) Field of Search ..... 33/1 G, 1 N, 452, 33/453, 456, 459, 463, 465, 471, 473, 534, 538, 558.01, 558.04, 558.4

(56) References Cited

U.S. PATENT DOCUMENTS

| | | | | | |
|---|---|---|---|---|---|
| 1,010,007 | A | | 11/1911 | Adams | |
| 1,068,124 | A | * | 7/1913 | Hall | 33/471 |
| 1,323,742 | A | | 12/1919 | Burroughs | |
| 1,999,105 | A | * | 4/1935 | Milla | 33/453 |
| 2,160,820 | A | * | 6/1939 | Bensen | 33/453 |
| 2,174,440 | A | | 9/1939 | Foley | |
| 2,718,063 | A | | 9/1955 | Ike | |
| 3,066,416 | A | * | 12/1962 | Gutting | 33/1 F |
| 3,191,308 | A | | 6/1965 | Lindenau | |
| 3,269,015 | A | | 8/1966 | Barker | |
| 3,568,319 | A | | 3/1971 | Moll | |
| 3,668,781 | A | | 6/1972 | Teter | |
| 3,760,766 | A | | 9/1973 | Wopschall | |
| 4,381,607 | A | * | 5/1983 | Place | 33/1 G |
| 4,566,198 | A | | 1/1986 | Vitale | |
| 4,575,943 | A | | 3/1986 | Baum, Jr. | |
| 5,357,683 | A | | 10/1994 | Trevino | |
| 5,414,938 | A | * | 5/1995 | Meek | 33/452 |
| 5,539,991 | A | * | 7/1996 | Harrison | 33/471 |
| 6,148,531 | A | * | 11/2000 | Economaki | 33/465 |
| 6,209,213 | B1 | | 4/2001 | Moe | |

* cited by examiner

*Primary Examiner*—Diego Gutierrez
*Assistant Examiner*—Madeline Gonzalez
(74) *Attorney, Agent, or Firm*—Patricia Smith King

(57) ABSTRACT

The present invention is directed to an apparatus and method for marking an angles relative to a baseline, the apparatus comprising two elongate arms, one arm having a length greater than that of the other, the arms being pivotally joined at one end by a connecting means having an aperture and anchoring means attached to the other ends for anchoring the arms to a first marker at one end of the baseline and a second marker marking the other end of the baseline to a specified length. The baseline length determines the size of the angles given the constant lengths of the first and second arms. The method may be employed by a single unskilled user to mark angles of any size greater than 0 and less than 180 degrees. The apparatus may be sized and proportioned for use on projects of widely varying scales.

15 Claims, 6 Drawing Sheets

DEVICE FOR ENABLING A SINGLE USER TO EASILY AND ACCURATELY MARK RIGHT AND OBLIQUE ANGLES AND METHOD FOR EMPLOYING SAME

CROSS-REFERENCES

Applicant requests that Disclosure Document no. 521106, filed at U.S. Patent and Trademark Office on 2002 Nov. 4, be associated with this application and be incorporated herein by reference.

STATEMENT REGARDING FEDERALLY SPONSORED RESEARCH OR DEVELOPMENT

Not applicable.

BACKGROUND

Craftspeople from carpenters to construction workers are required to accurately orient surfaces or edges at various angles to one another. Advances in design have introduced the need for orienting surfaces at more than just right angles to one another and to do so with great accuracy. Economic pressures have further introduced the need to perform angle measurements more rapidly and consistently while using cheaper, and often relatively unskilled, labor.

Prior attempts to address these needs are inadequate to the task. Though various methods and apparatuses currently exist to facilitate the measurement of angles, they generally only measure right angles and must be implemented by more than one person. Nor may they be easily adapted for work on a range of scales (e.g., from use in making furniture to use in siting the foundations of large buildings, for example).

Information relevant to attempts to address these problems can be found in U.S. Pat. Nos. 1,010,007; 1,323,742; 1,458,046; 2,174,440; 2,718,063; 3,191,308; 3,269,015; 3,568,319; 3,668,781; 3,760,766; 4,566,198; 4,575,943; 5,357,683, and 6,209,213. However, each one of these references suffers from one or more of the following disadvantages: (a) it only measures right angles; (b) it requires more than one person to operate; (c) it cannot be easily adapted for use on different scales; (d) it requires a user to make calculations; (e) it involves devices that are bulky and difficult to transport and to store; (f) it comprises numerous moving parts prone to breakage and dysfunction; (g) it is prone to error as angles are measured on too small a scale to ensure minimal error; and, (h) for any number of the previous reasons, it is unusable by relatively unskilled labor.

For the foregoing reasons, there is a need for an apparatus and method of employing same that enables a single user to easily and accurately mark both right and oblique angles and that may be adapted for use on a variety of scales.

SUMMARY

The present invention is directed to an apparatus and method for employing same that satisfies these needs whereby the apparatus may be used by a single unskilled user to mark a reference line defining an angle to a baseline simply by measuring the baseline to a specified length and attaching the apparatus thereto, thus avoiding the need to directly measure the desired angle, minimizing error by restricting measurements to the length of the baseline alone and enabling the user to mark the angle to any size greater than 0 and less than 180 degrees.

The apparatus for marking an angle relative to a baseline comprises: (a) first and second elongate arms, the second arm having a length greater than that of the first arm, each of the arms having a proximal end and an opposed distal end, the first and second arms being pivotally joined one to the other at their proximal ends by a connecting means having a centrally located aperture; and, (b) first and second anchoring means, the first anchoring means being attached to the distal end of the first arm for anchoring the first arm to a first marker, the first marker marking one end of the baseline located on a work surface, the second anchoring means being attached to the distal end of the second arm for anchoring the second arm to a second marker marking the other end of the baseline to a specified baseline length, the first marker thereby marking the vertex of an inner angle formed by the baseline and a reference line extending from the vertex to a center of the aperture when the first and second arms are fully extended, the baseline length determining the size of the inner angle formed by the reference and baselines, and also defining the size of an outer angle sharing the same vertex and formed by an extension of the baseline therefrom and the reference line.

The apparatus may thus be used by a single user to mark the reference line to a desired angle to the baseline, simply by marking both ends of the baseline to a specified length apart and attaching the apparatus to each end thereof, thus avoiding the need to directly measure the desired angle, minimizing error by restricting measurements to the length of the baseline alone and enabling the user to mark the inner or outer angle to any size greater than 0 and less than 180 degrees.

In another version, a method is provided for using the apparatus described above.

These and other features and aspects of the apparatus and method will become better understood with reference to the following description, accompanying drawings, and appended claims.

Several objects and advantages of the present invention are: (a) to provide an apparatus that may be used by a single unskilled user to mark a reference line to a desired angle to a baseline, simply by marking the baseline to a specified length and attaching the apparatus thereto, thus avoiding the need to directly measure the desired angle, minimizing error by restricting measurements to the length of the baseline alone and enabling the user to mark the angle to any size greater than 0 and less than 180 degrees; (b) to provide an apparatus with few parts to minimize the probability of a malfunction; (c) to provide an apparatus that can be adapted by means of changing its relative size (and varying the baseline lengths required to mark angles of various sizes accordingly) to suit its purpose for jobs of greatly differing scales such as positioning foundations of a building, cutting wood surfaces in the manufacture of furniture, establishing vertical tab lines when shingling, and squaring decks, sidewalks or fencing.

The reader is advised that this summary is not meant to be exhaustive. Further features, aspects, and advantages of the present invention will become better understood with reference to the following description, accompanying drawings and appended claims. In particular, though the invention is described in its application to construction and carpentry, it may also be applied to any type of craft requiring that angles be marked.

BRIEF DESCRIPTION OF DRAWINGS

For a better understanding of the present invention, reference may be made to the accompanying drawings, in which:

FIG. 5*b* showing the placement of the second marker so as to define a baseline of a specified baseline length; FIG. 5*c* showing the apparatus attached to the first and second markers by the anchoring means with its arms fully extended to enable marking the center of the aperture; and FIG. 5*d* showing the reference line marked between the first marker and the aperture mark so as to mark the angle; and, FIG. 6, shows a version of the apparatus with optional third arm.

REFERENCE NUMERALS IN DRAWINGS

Figure 1:
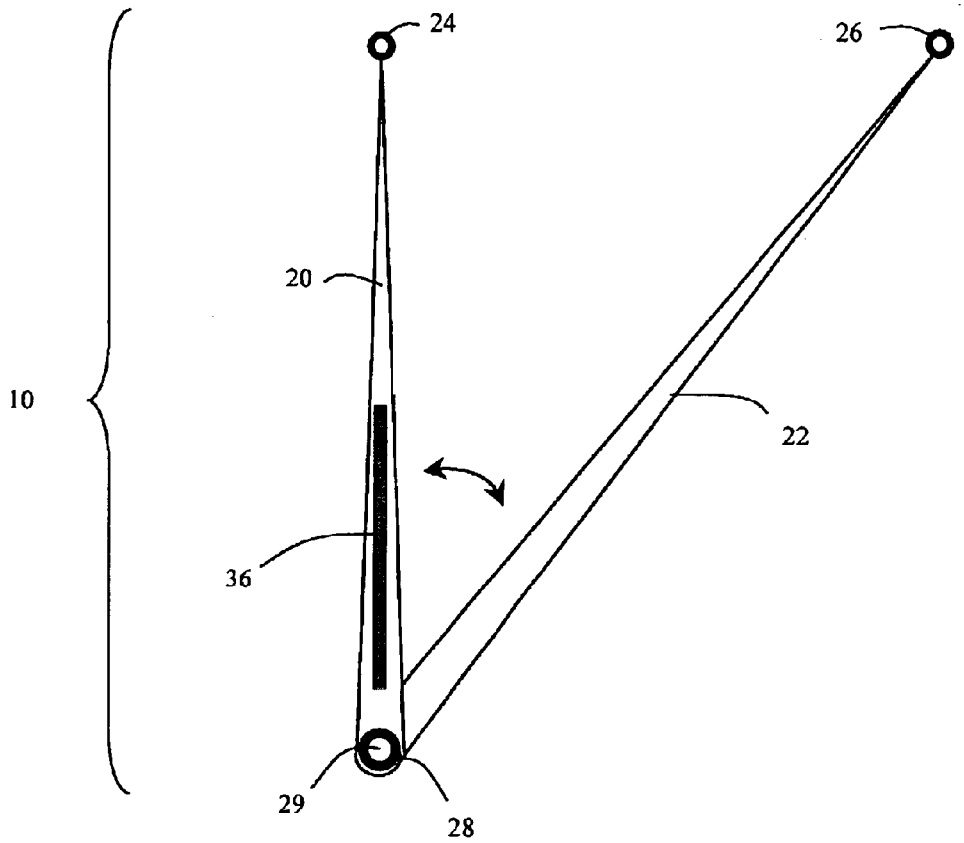
FIG. 1, shows a schematic diagram depicting one version of the apparatus.

| | | | |
|---|---|---|---|
| 10 | angle device | 20 | first arm |
| 22 | second arm | 23 | optional third arm |
| 24 | first anchoring means of arm 20 | 26 | second anchoring means of arm 22 |
| 28 | connecting means | 29 | aperture of connecting means 28 |
| 30 | baseline | 32 | first marker |
| 34 | second marker | 36 | chart of baseline lengths 38 |
| 38 | baseline length | 39 | extension of baseline 30 |
| 40 | reference line | 50 | inner angle |
| 52 | outer angle | 56 | vertex of angles 50 and 52 |

DESCRIPTION

Referring now specifically to the figures, in which identical or similar parts are designated by the same reference numerals throughout, a detailed description of the present invention is given. It should be understood that the following detailed description relates to the best presently known embodiment of the invention. However, the present invention can assume numerous other embodiments, as will become apparent to those skilled in the art, without departing from the appended claims. For example, the present invention may be sized for application to projects ranging from construction of furniture to construction of large buildings, and any other application to which the device and method may be beneficially applied. For example, the invention may be applied to other applications such as mapping or drawing generally where the marking of angles is desired.

It should also be understood that, while the methods disclosed herein may be described and shown with reference to particular steps performed in a particular order, these steps may be combined, sub-divided, or re-ordered to form an equivalent method without departing from the teachings of the present invention. Accordingly, unless specifically indicated herein, the order and grouping of the steps is not a limitation of the present invention.

DEFINITIONS

Right angle: an angle of 90 degrees.

Oblique angle: an angle that is neither a right angle nor a multiple of a right angle. Oblique angles include both acute angles and obtuse angles.

Acute angle: an angle less than 90 degrees.

Obtuse angle: an angle greater than 90 degrees and less than 180 degrees.

Vertex of an angle: common point from which two rays emanate to form the angle.

DETAILED DESCRIPTION

The angle device 10 of the present invention can assume various forms and sizes to suit projects from marking angles in the making of furniture, to siting foundations for large buildings. The simplicity of its design and the requirement that only a baseline 30 be measured to a certain length 38, ensures that angles can be marked accurately and quickly by even the most unskilled user.

Referring to FIG. 1, a basic stylized depiction of the angle device 10 is illustrated. The device 10 comprises two elongated arms, a first arm 20 and a second arm 22. The second arm 22 is of a length greater than that of the first arm 20. For example, the first and second arms 20 and 22 are illustrated in FIGS. 1–4*c* as having lengths of 4 and 5 feet (121.92 and 152.40 cm), respectively.

Figure 2A:
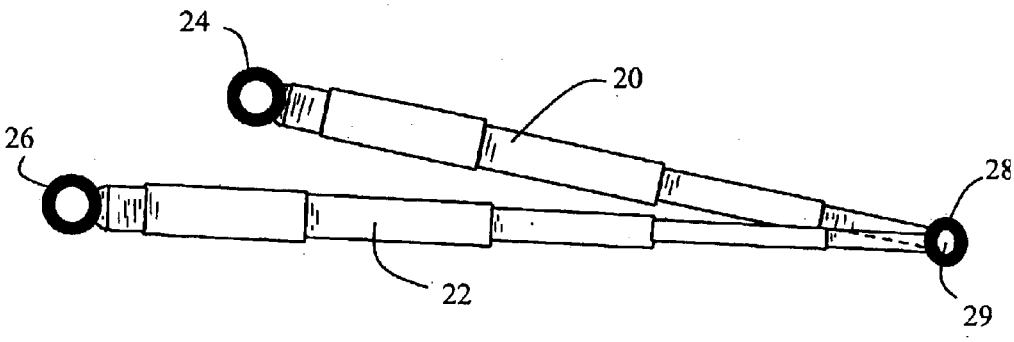
FIG. 2*a*, shows a top view of one version of the apparatus in which the arms are collapsible.
Figure 2B:
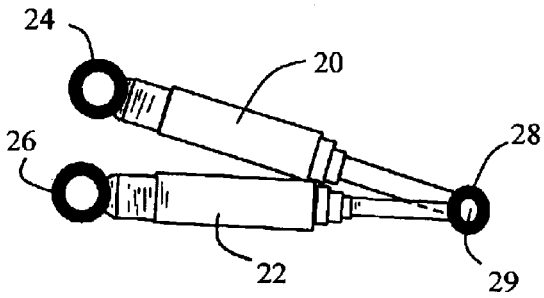
FIG. 2*b*, shows the apparatus in FIG. 2*a* in which the arms are in their collapsed position.
Figure 2C:
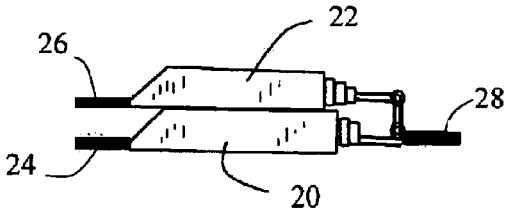
FIG. 2*c*, shows a side view of the apparatus fully collapsed as in FIG. 2*b;*

The arms 20 and 22 are made of a material that will resist changes in length. The material may be rigid such as wood, ceramic, metal, hard plastic or the like. Alternatively, the material may be flexible such as wire, rope, cording, tape, flexible plastics and the like. If the arms 20 and 22 are made from a flexible material, they may be folded or rolled for storage and transport. If the arms 20 and 22 are made of a rigid material, they may be constructed in single pieces (as shown in FIG. 1) or alternatively, they may be constructed of several pieces to enable them to collapse or fold for easier storage and transport (as shown in FIGS. 2*a*–2*c*, collapsible version). Many alternative materials and forms for the arms 20 and 22 are possible so long as accurate retention of their lengths when fully extended is assured.

The first and second arms 20 and 22 each have a proximal end and an opposed distal end. The arms 20 and 22 are pivotally joined one to the other at their proximal ends by a connecting means 28 having an aperture 29 generally located centrally therein. The connecting means 28 may be any of a variety of types such as a rivet, bolt or other form of coupling.

A first anchoring means 24 is attached to the distal end of the first arm 20 for anchoring the first arm to a first marker 32. The first marker 32 marks one end of a baseline 30 located on a work surface (see FIGS. 3*a*–3*c* and 4*a* –4*c*). A second anchoring means 26 is attached to the distal end of the second arm 22 for anchoring the second arm 22 to a second marker 34, thus marking the other end of the baseline 30 to a specified baseline length 38. The work surface can vary with the project from the surface of a piece of wood, a floor in the interior of a home, a dirt yard at a building construction site and the like.

The markers 32 and 34 may be of a variety of types such as pins, tacks, stakes, nails and the like. The first and second anchoring means 24 and 26 may likewise vary to include eye rings, clasps, clips and the like.

Figure 6:
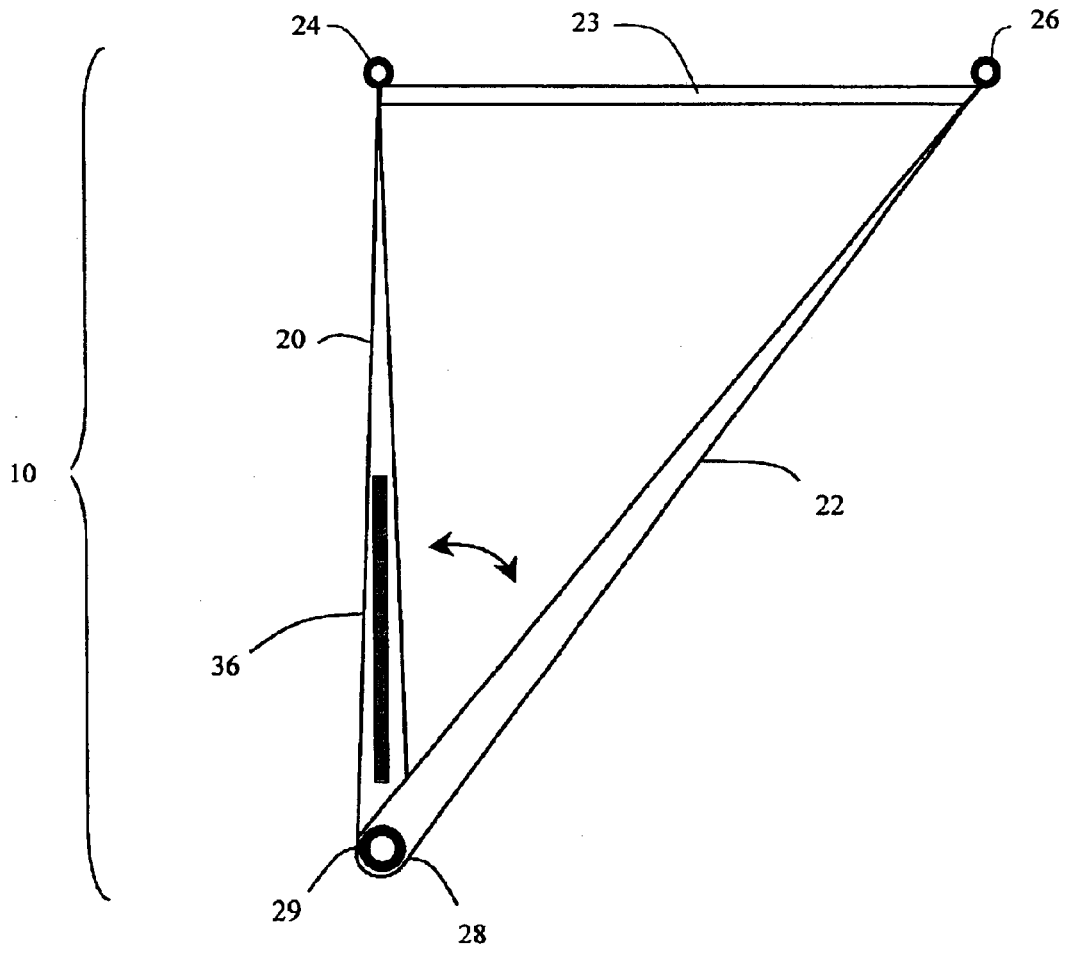

There may optionally also be a third arm 23 (see FIG. 6) attached to the distal end of arm 20 or 22. The third arm 23, when present, serves to connect the distal ends of arms 20 and 22 to a pre-specified width apart when fully extended. It may be attached to the distal end of arm 20 and extend to connect to the distal end of arm 22, or vice versa.

The third arm 23 will typically retract when not in use or rotate to fold into the arm 20 or 22 to which it is attached. Any number of alternative means may be employed to attach the third arm 23 to arm 20 or 22, and likewise to connect it to the remaining arm when extended. The third arm 23 may retract similarly to tape measures, telescope as illustrated for arms 20 and 22 in FIGS. 2*a–c*, fold back onto the arm to which it is attached or by other like means.

The third arm 23 serves to eliminate the need for measuring the baseline length 38 for an angle size commonly required, substituting instead the pre-measured length of the third arm 23 for the baseline length 38. In this way, the third arm 23 increases the efficiency with which the device 10 is used to mark angle 50 to a size most often needed.

For example, if the device 10 will be used to mark right angles most often, the third arm 23 would measure the equivalent baseline distance 38 required to mark the right angle. In the case of a device 10 with arms 20 and 22 measuring 48 and 60 inches, respectively, the third arm 23 would measure 36 inches, thus creating a 3-4-5 right triangle (with angle 50 measuring 90 degrees) when the arms 20, 22 and 23 are all fully extended in place (see FIG. 6, Table 1). Likewise, if the device 10 is used for a purpose often requiring 45 degree angles, the third arm 23 would measure the distance 38 to mark a 45 degree angle 50 when arms 20, 22 and 23 are all fully extended in place. In the present example with arms 20 and 22 measuring 48 and 60 inches, respectively, the third arm 23 would measure 83.42 inches in length (see Table 1). The third arm 23 lengths will, of course, be particular to the size of device 10.

With or without the optional third arm 23, the device 10 functions to mark angles 50 or 52 of all angle sizes by measurement of baseline lengths 38 and attaching arms 20 and 22 to each end as described above. The optional third arm 23 simply serves to eliminate the need to measure the baseline length 38 when marking a particular angle size commonly required in a given type of work.

The lengths of the arms 20 and 22 are measured from the aperture 29 of the connecting means 28 and the anchoring means (24 and 26) at the opposed distal end of each. In this way, the arms 20 and 22 can be constructed to known and accurately determined lengths so as to enable base line lengths 38 to be calculated for marking angles 50 and 52 of various sizes.

The fist and second arms 20 and 22, together with the baseline 30, thus form a triangle when anchored to the markers 32 and 34. The first marker 32 marks the vertex 56 of an inner angle 50 formed by the baseline 30 and a reference line 40 extending from the vertex 56 to a center of the aperture 29 when the arms 20 and 22 are fully extended (FIGS. 3*a*–4*c*).

The baseline length 38 determines the size of the inner angle 50 and also the size of its complimentary outer angle 52. The outer angle 52 shares the same vertex 56 as angle 50 and is formed by a straight-line extension 39 of the baseline 30 from the vertex 56, and by the reference line 40 (see FIGS. 3*a*–3*c* and 4*a*–4*c*).

The angle device 10 may thus be used easily by a single user to mark the reference line 40 to the desired angle to the baseline 30, simply by marking both ends of the baseline to a specified length 38 apart and attaching the device 10 to each end thereof. In this way, the need to directly measure the desired angle 50 (or 52) is avoided, measurements are restricted to the length 38 of the baseline alone thus minimizing error, and the user is able to mark the inner or outer angle 50 or 52 to any size greater than 0 and less than 180 degrees.

How the Invention Is Used

The method for marking an angle 50 or 52 relative to a baseline 30 using the angle device 10 is simple and requires little skill to mark angles accurately and quickly.

Referring to FIGS. 5*a*–5*d*, the general steps in the method are illustrated. A baseline 30 is marked on a work surface; Markers 32 and 34 are used to mark both ends of the baseline 30 to a specified length 38. As mentioned above, markers 32 and 34 may be of a variety of types such as pins, tacks, stakes, nails and the like.

Figure 5A:
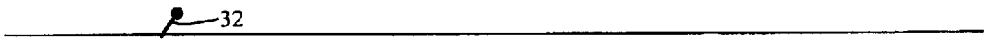
FIGS. 5*a* to 5*d*, show the basic steps in one version of the method, FIG. 5*a* showing the placement of the first marker.
Figure 5B:
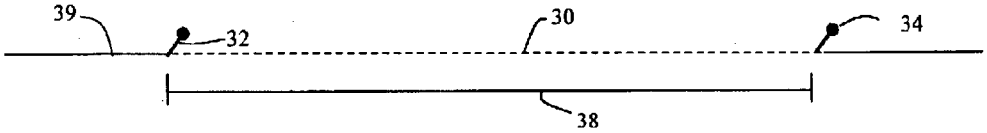

A first marker 32 is positioned on a work surface to mark the first end of the baseline 30 (FIG. 5*a*). A second marker 34 is positioned at a specified distance 38 from the first marker 32 to form the baseline 30 (FIG. 5*b*). The distance 38 is determined by reference to a chart 36 such as that given below in Table 1. The chart 36 presents baseline lengths 38 required to mark an angle 50 or 52 of a certain size given the lengths of arms 20 and 22. The chart 36 may be separately provided for reference by the user. Alternatively, the chart 36 (in whole or in part) may be provided on one or both of the arms 20 or 24 as depicted in FIG. 1.

In the case where optional third arm 23 is provided, the user may alternatively extend the third arm 23 from one arm 20 or 22 to the other to achieve a length equivalent to the baseline length 38 required to measure an angle 50 of a certain size. The user extends the third arm 23 from the arm to which it is attached (20 or 22) to the distal end of the remaining arm and connects it thereto. Once the third arm 23 and arms 20 and 22 are fully extended and interconnected, angle 50 is of the desired size and may be marked. The device 10 is positioned so that arm 23 is aligned with a baseline 30 and the reference line 40 marked as described above. In this way, the user eliminates the steps of placing the markers 30 and 32, and measuring the baseline length 38, thus increasing the efficiency with which a commonly required angle size is marked.

When not in use, the third arm 23 is retracted and the device used normally as described above. When third arm 23 is not used, the user may mark the baseline length 38 as described above for angles 50 or 52 of all other sizes.

Figure 5C:
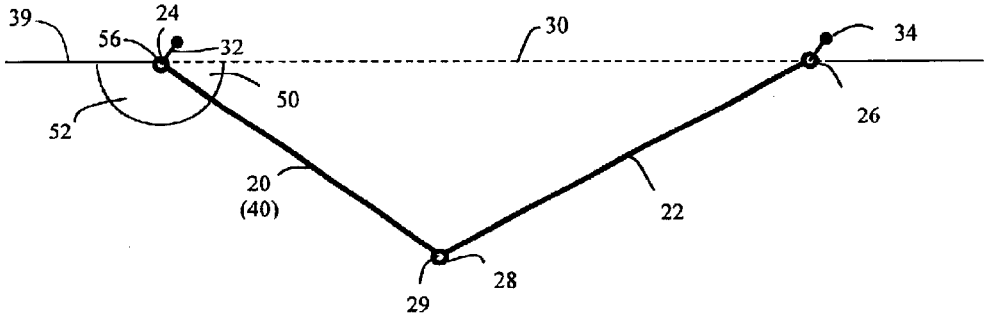

Once the baseline 30 is marked to the specified length 38, the angle device 10 is anchored to the first and second markers 32 and 34 by anchoring means 24 and 26 of each arm 20 and 22. Anchoring means 24 of the first arm 20 is attached to the first marker 30, while anchoring means 26 of the second arm 22 is attached to the second marker 34 (FIG. 5*c*).

Figure 5D:
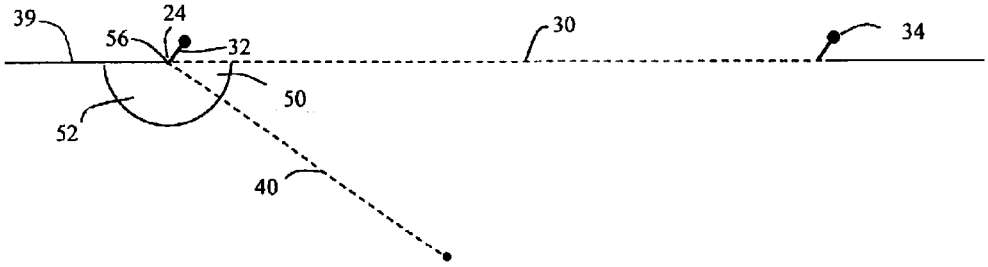

The arms 20 and 24 are then fully extended to form a triangle together with the baseline 30. Once the device 10 is properly positioned, a mark is made on the work surface at the aperture 29 of the connecting means 28 (FIG. 5*c*). The mark may be made with a pencil, pen or other similar marker, or with a nail, pin or stake, depending on the circumstance. The device 10 is then removed and a reference line 40 sited from the mark at aperture 29 to the first marker 32 (FIG. 5*d*).

A straight-line extension 39 of the baseline 30 may be marked extending the line beyond the first marker 32. In this way, the reference line 40, together with the baseline 30 and its extension 39, intersect where the reference line 40 begins at the first marker 32. This point of intersection becomes the vertex 56 of two angles, an inner angle 50 and its complimentary outer angle 52, either of which may be used by the user as the desired angle to mark (FIG. 5*d*).

A user has thus easily and accurately marked at least one desired angle 50 or 52 for use in a project, and it required only that the user measure a single distance 38. Employing devices 10 of differing sizes further enables use of the device 10 for accurately marking angles 50 or 52 in projects varying widely in scale.

As mentioned above, the baseline length 38 determines the size of the angles 50 and 52 and is dependent on the lengths of the first and second arms 20 and 22. An example of a chart 36 that may be used with a device 10 having first and second arms of 48 and 60 inches (121.92 cm and 152.40 cm) in length, respectively, is given below in Table 1. Table 1 shows examples of baseline lengths 38 required to mark inner angles 50(and complimentary outer angles 52) of various sizes. However, it is possible to mark angles 50 and 52 of all sizes using the angle device 10. Likewise, calculations may be made to produce similar charts 36 of baseline lengths 38, for angle devices 10 with first and second arms 20 and 22 of various other lengths other than 48 and 60 inches. Indeed the beauty of the angle device 10 is that it is so readily adaptable to different size scales. The device 10 can be made with first and second arms measuring 4 and 5 inches (10.16 cm and 12.7 cm), 4 and 5 feet (121.92 cm and 152.40 cm), 20 and 25 feet (5.08 m and 6.35 m) and the like. Nor do the arm lengths have to be proportioned 4 to 5. The sizing of the device 10 may be varied to match the scale of the project.

In addition, though the baseline lengths 38 in Table 1 are given to the nearest hundredth of an inch, these fractions may be converted to a nearest number of quarter-, eighth- or sixteenth-inches to facilitate measurement by a user using commonly available tape measures and the like. Hence, for example, 101.47 inches may be given as 101½". Likewise, 61.61 inches may be given as 61⅝".

Figure 3A:
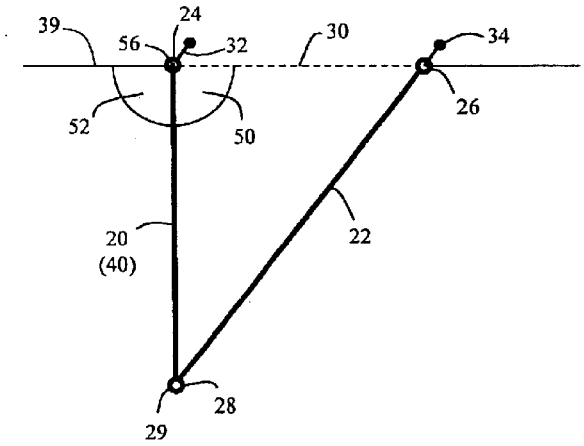
FIG. 3*a*, shows the placement of a stylized version of the apparatus so as to mark a reference line disposed at a right angle to the baseline.
Figure 3B:
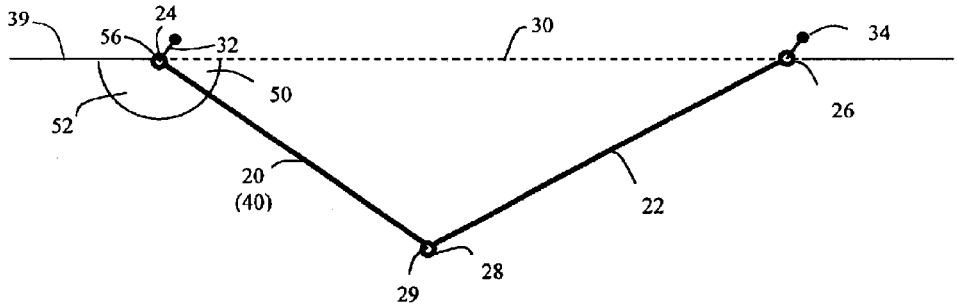
FIG. 3*b*, shows the placement of a stylized version of the apparatus so as to mark a reference line disposed at a 45 degree acute angle to the baseline.
Figure 3C:
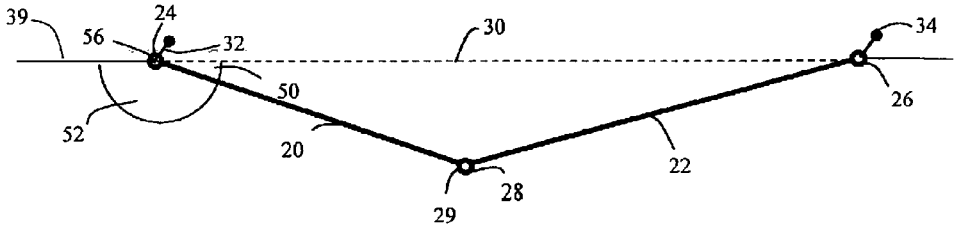
FIG. 3*c*, shows the placement of a stylized version of the apparatus so as to mark a reference line disposed at a 22.5 degree acute angle to the baseline.
Figure 4A:
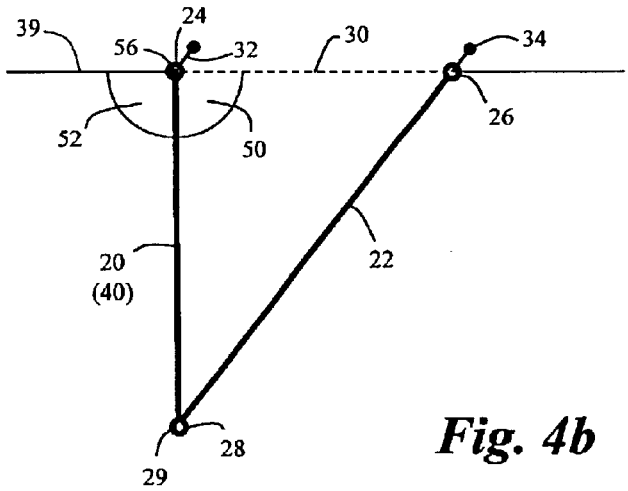
FIG. 4*a*, shows the placement of a stylized version of the apparatus so as to mark a reference line disposed at a right angle to the baseline.
Figure 4B:
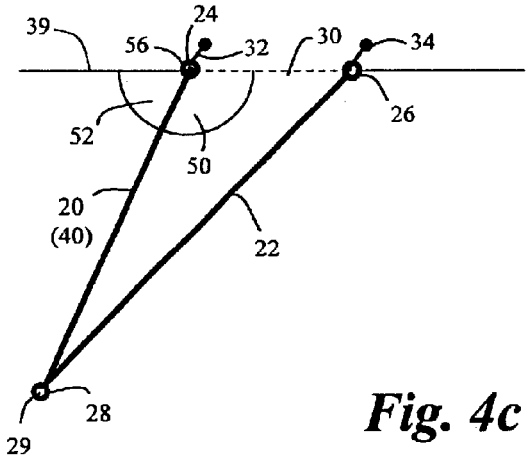
FIG. 4*b*, shows the placement of a stylized version of the apparatus so as to mark a reference line disposed at a 112.5 degree obtuse angle to the baseline.
Figure 4C:
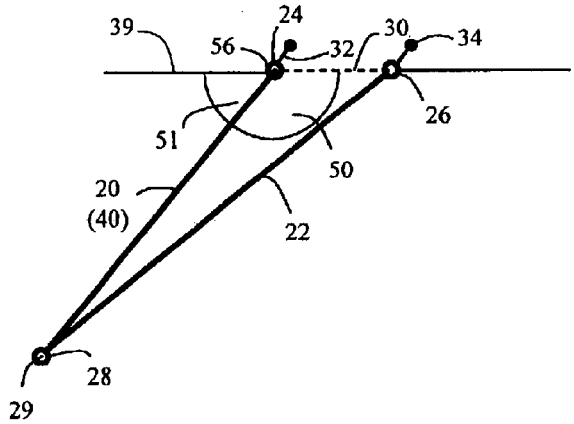
FIG. 4*c*, shows the placement of a stylized version of the apparatus so as to mark a reference line disposed at a 135 degree obtuse angle to the baseline.

The baseline lengths 38 to mark angles 50 and 52 of various sizes were calculated by solving the following trigonometric formula for the value of the baseline length 38 given the lengths of arms 20 and 22 and the size of the angle 50. However, alternative methodologies may likewise be employed.

$$A2=[A1^2+BL^2-2*A1*BL*\cos(\theta*\pi/180)]^{0.5}$$

where,

A1=length of first arm 20;

A2=length of second arm 22;

BL=length 38 of baseline 30;

θ=size of angle 50 (degrees);

Using the angle device 10 one can mark inner angles 50 that are right angles or oblique angles (i.e., acute or obtuse angles). FIGS. 3*a*–3*c* give examples of inner angles 50 that are right (FIG. 3*a*) and acute (FIGS. 3*b*–3*c*). FIGS. 4*b*–4*c* similarly provide examples of inner angles 50 that are right (FIG. 4*a*) and obtuse (FIGS. 3*b*–3*c*). If the angle 50 is acute, its complimentary outer angle 52 is obtuse, and vice versa. Depending on the circumstances, the user may find it more convenient to use the angle device 10 to locate the angle 50 or 52.

TABLE 1

| Angles (degrees) | | Lengths (inches) | | |
|---|---|---|---|---|
| Inner Angle 50 | Outer Angle 52 | Arm 20 | Arm 22 | Baseline Length 38 |
| 5 | 175 | 48 | 60 | 107.67 |
| 10 | 170 | 48 | 60 | 106.69 |
| 15 | 165 | 48 | 60 | 105.06 |
| 20 | 160 | 48 | 60 | 102.82 |
| 22.5 | 157.5 | 48 | 60 | 101.47 |
| 25 | 155 | 48 | 60 | 99.97 |
| 30 | 150 | 48 | 60 | 96.56 |
| 35 | 145 | 48 | 60 | 92.63 |
| 40 | 140 | 48 | 60 | 88.23 |
| 45 | 135 | 48 | 60 | 83.42 |
| 50 | 130 | 48 | 60 | 78.27 |
| 55 | 125 | 48 | 60 | 72.85 |

TABLE 1-continued

| Angles (degrees) | | Lengths (inches) | | |
|---|---|---|---|---|
| Inner Angle 50 | Outer Angle 52 | Arm 20 | Arm 22 | Baseline Length 38 |
| 60 | 120 | 48 | 60 | 67.27 |
| 65 | 115 | 48 | 60 | 61.61 |
| 67.5 | 112.5 | 48 | 60 | 58.78 |
| 70 | 110 | 48 | 60 | 55.98 |
| 75 | 105 | 48 | 60 | 50.51 |
| 80 | 100 | 48 | 60 | 45.29 |
| 85 | 95 | 48 | 60 | 40.43 |
| 90 | 90 | 48 | 60 | 36.00 |
| 112.5 | 67.5 | 48 | 60 | 22.05 |
| 135 | 45 | 48 | 60 | 15.54 |

Applying the baseline lengths 38 in Table 1, FIG. 3*a* illustrates how a right angle 50 is marked by measuring a baseline length 38 of 36.00 inches when the arms 20 and 22 of device 10 measure 48 and 60 inches, respectively (forming a 3-4-5 right triangle in this case). FIG. 3*b* illustrates how a 45-degree acute angle 50 (and its complimentary 135-degree obtuse angle 52) is marked by measuring a baseline length 38 of 83.42 inches. And FIG. 3*c* illustrates how a 22.5-degree acute angle 50 (and its complimentary 157.5-degree obtuse angle 52) is marked by measuring a baseline length 38 of 101.47 inches.

Similarly, FIG. 4*b* illustrates how a 112.5-degree obtuse angle 50 is marked by measuring a baseline length 38 or 22.05 inches. And, FIG. 4*c* illustrates how a 135-degree obtuse angle 50 is marked by measuring a baseline length of 15.54 inches. As in FIGS. 3*b* and 3*c*, FIGS. 4*b* and 4*c* show how complimentary acute outer angles 52 are likewise marked.

Advantages of the Invention

The previously described versions of the present invention have many advantages, including: (a) to provide an apparatus that may be used by a single unskilled user to mark a reference line to a desired angle to a baseline simply by marking the baseline to a specified length and attaching the apparatus thereto, thus avoiding the need to directly measure the desired angle, minimizing error by restricting measurements to the length of the baseline alone and enabling the user to mark the angle to any size greater than 0 and less than 180 degrees; (b) to provide an apparatus with few parts to minimize the probability of a malfunction; (c) to provide an apparatus that can be adapted by means of changing its relative size (and varying the baseline lengths required to mark angles of various sizes accordingly) to suit its purpose for jobs of greatly differing scales such as positioning foundations of a building, cutting wood surfaces in the manufacture of furniture, establishing vertical tab lines when shingling, and squaring decks, sidewalks or fencing.

The present invention does not require that all the advantageous features and all the advantages need to be incorporated into every embodiment thereof.

Closing

Although the present invention has been described in considerable detail with reference to certain preferred versions thereof, other versions are possible. Therefore, the spirit and scope of the appended claims should not be limited to the description of the preferred versions contained herein.

What is claimed is:

1. An apparatus for marking an angle relative to a baseline, the apparatus comprising:

first and second elongate arms, the second arm having a length greater than that of the first arm, each of said arms having a proximal end and an opposed distal end, the first and second arms being pivotally joined one to the other at their proximal ends by a connecting means having an aperture located therein;

first and second anchoring means, the first anchoring means being attached to the distal end of the first arm for anchoring the first arm to a first marker, the first marker marking one end of the baseline located on a work surface, the second anchoring means being attached to the distal end of the second arm for anchoring the second arm to a second marker marking the other end of the baseline to a specified baseline length, the first marker thereby marking a vertex of an inner angle formed by the baseline and a reference line extending from the vertex to a center of the aperture when the arms are fully extended, the baseline length determining the size of the inner angle and determining the size of an outer angle sharing the vertex and formed by the reference line and an extension of the baseline therefrom; and, a chart located on a surface of the first or second arms providing the specified baseline lengths required to achieve inner or outer angles of given sizes so as to enable easy access by the user;

whereby the apparatus may be used by a single user to mark the reference line to the desired angle to the baseline, simply by marking both ends of the baseline to a specified length apart and attaching the apparatus to each end thereof thus avoiding the need to directly measure the desired angle, minimizing error by restricting measurements to the length of the baseline alone and enabling the user to mark the inner or outer angle to any size greater than 0 and less than 180 degrees.

2. The apparatus of claim 1, wherein the length of each arm is measured from the aperture of the connecting means to the anchoring means at the opposed distal end thereof.

3. The apparatus of claim 1, further comprising a third arm attached to the distal end of one of the first or second arms and extendable therefrom for connection to the distal end of the remaining first or second arm, to mark an inner angle of a size dependent on a length of the third arm.

4. The apparatus of claim 1, wherein the first and second arms are comprised of a material able to retain a constant length.

5. The apparatus of claim 4, wherein the material is a flexible material.

6. The apparatus of claim 4, wherein the material is an inflexible material.

7. The apparatus of claim 6, wherein the first and second arms are collapsible to enable storage in a smaller space.

8. A method for marking an angle relative to a baseline, the method comprising:

providing an apparatus comprising:

first and second elongate arms, the second arm having a length greater than that of the first arm, each of said arms having a proximal end and an opposed distal end, the first and second arms being pivotally joined one to the other at their proximal ends by a connecting means having an aperture located therein; and, first and second anchoring means, the first anchoring means being attached to the distal end of the first arm for anchoring the first arm to a first marker, the second anchoring means being attached to the distal end of the second arm for anchoring the second arm to a second marker;

marking a baseline on a work surface to a specified baseline length by placing the first marker at one end of the baseline, measuring the specified length along the baseline and placing the second marker to mark the opposite end of the baseline;

attaching the first and second arms to the first and second markers by attaching the first and second anchoring means thereto and extending the first and second arms fully;

marking the work surface at the center of the aperture;

marking a reference line between the first marker and the aperture mark, the first marker thereby marking a vertex of an inner angle formed by the baseline and the reference line, the baseline length determining the size of the inner angle thus formed and also determining the size of an outer angle sharing the same vertex and formed by the reference line and an extension of the baseline therefrom;

whereby the method may be used by a single user for marking the reference line to the desired angle to the baseline, simply by marking both ends of the baseline to a specified length apart and attaching the apparatus to each end thereof thus avoiding the need to directly measure the desired angle, minimizing error by restricting measurements to the length of the baseline alone and enabling the user to mark the inner or outer angle to any size greater than 0 and less than 180 degrees.

9. The method of claim 8, wherein the length of each arm is measured from the aperture of the connecting means to the anchoring means at the opposed distal end thereof.

10. The method of claim 8, wherein the specified baseline lengths required to achieve inner or outer angles of given sizes are provided in a chart located on a surface of the first or second arms to enable easy access by the user.

11. The method of claim 8, wherein the apparatus further comprises a third arm attached to the distal end of one of the first or second arms and extendable therefrom for connection to the distal end of the remaining first or second arm, for marking an inner angle of a size dependent on a length of the third arm.

12. The method of claim 8, wherein the first and second arms are comprised of a material able to retain a constant length.

13. The method of claim 12, wherein the material is a flexible material.

14. The method of claim 12, wherein the material is an inflexible material.

15. The method of claim 14, wherein the first and second arms are collapsible to enable storage in a smaller space.

* * * * *